US008391498B2

(12) United States Patent
Potard

(10) Patent No.: US 8,391,498 B2
(45) Date of Patent: Mar. 5, 2013

(54) STEREOPHONIC WIDENING

(75) Inventor: Guillaume Potard, Sydney (AU)

(73) Assignee: Dolby Laboratories Licensing Corporation, San Francisco, CA (US)

( * ) Notice: Subject to any disclaimer, the term of this patent is extended or adjusted under 35 U.S.C. 154(b) by 285 days.

(21) Appl. No.: 12/867,094

(22) PCT Filed: Feb. 11, 2009

(86) PCT No.: PCT/US2009/033735

§ 371 (c)(1),
(2), (4) Date: Sep. 14, 2010

(87) PCT Pub. No.: WO2009/102750

PCT Pub. Date: Aug. 20, 2009

(65) Prior Publication Data

US 2011/0194712 A1 Aug. 11, 2011

Related U.S. Application Data

(60) Provisional application No. 61/028,654, filed on Feb. 14, 2008.

(51) Int. Cl.
*H04R 5/00* (2006.01)

(52) U.S. Cl. ..... 381/1; 381/10; 381/17; 381/300; 381/97; 381/99

(58) Field of Classification Search ..... 381/1, 17–18, 381/300, 303, 10, 97–99
See application file for complete search history.

(56) References Cited

U.S. PATENT DOCUMENTS

| | | | | |
|---|---|---|---|---|
| 4,191,852 | A * | 3/1980 | Nishikawa | 381/1 |
| 5,757,931 | A | 5/1998 | Yamada | |
| 6,111,958 | A | 8/2000 | Maher | |
| 6,636,608 | B1 | 10/2003 | Kishii | |
| 7,440,575 | B2 * | 10/2008 | Kirkeby | 381/1 |
| 7,801,317 | B2 * | 9/2010 | Kim | 381/303 |
| 7,991,176 | B2 * | 8/2011 | Kirkeby | 381/334 |
| 8,229,143 | B2 * | 7/2012 | Bharitkar et al. | 381/300 |
| 2002/0097880 | A1 * | 7/2002 | Kirkeby | 381/1 |
| 2003/0219137 | A1 | 11/2003 | Fincham | |
| 2004/0136554 | A1 | 7/2004 | Kirkeby | |
| 2011/0243338 | A1 * | 10/2011 | Brown | 381/17 |

FOREIGN PATENT DOCUMENTS

| | | |
|---|---|---|
| EP | 1194007 | 4/2002 |
| JP | 54-058404 | 5/1979 |
| JP | 56-162600 | 12/1981 |
| JP | 2000-506691 | 5/2000 |
| JP | 2005-529520 | 9/2005 |
| JP | 2006-500626 | 1/2006 |
| JP | 2006-303799 | 11/2006 |
| JP | 2008-028640 | 2/2008 |
| RU | 93014671 | 4/1995 |
| WO | 0022880 | 4/2000 |

* cited by examiner

*Primary Examiner* — Disler Paul

(57) ABSTRACT

Widening stereophonic response is achieved in sound reproduction systems with at least two loudspeakers. A stereo signal input is accessed, which includes multiple frequency components. The loudspeakers are close to each other. A frequency range of the frequency components is decorrelated, e.g., upon pre-processing the stereo signal. The sound reproduction system's stereophonic response is widened, based on the decorrelation.

14 Claims, 9 Drawing Sheets

Example Sampe 100

Example Decorrelation Filter 600

Example Amplitude & Phase Responses 700

Example Decorrelation Filter Phase Response & Cross-over Filter Amplitude 1100

STEREOPHONIC WIDENING

RELATED UNITED STATES APPLICATION

This application is claims priority to related U.S. Provisional Patent Application No. 61/028,654, filed on Feb. 14, 2008, by Guillaume Potard entitled Stereophonic Widening (with Dolby Laboratories Reference No. D08003 US01), which is assigned to the Assignee of the present application ands which is incorporated herein by reference, as if fully set forth herein.

TECHNOLOGY

The present invention relates generally to audio reproduction. More specifically, embodiments of the present invention relate to stereophonic widening.

BACKGROUND

Psychoacoustically perceived audio qualities such as richness, fullness, depth and spaciousness describe a "soundstage" that relates to listeners' audio experience. Such qualities may affect listeners' subjective audio involvement, as well as their overall spatial perception of the soundstage. Stereophonic audio ("stereo") uses at least two (2) distinct or independent audio channels for reproducing sound with multiple loudspeakers. Stereo audio reproduces sound so that it may be perceived from multiple directions.

For persons with essentially normal binaural hearing, stereo audio may provide a somewhat natural sounding listening experience that may, in a sense, be considered aurally fulfilling. Stereo audio may use stereophonic projection, in which relative positions associated with recorded sound components of the audio content are encoded and reproduced to generate elements or components of the soundstage. Loudspeaker placement and separation may affect soundstage perception.

This section describes approaches that could be pursued, but not necessarily approaches that have been previously conceived or pursued. Thus, unless otherwise indicated, it should not be assumed that any of the approaches described in this section qualify as prior art merely by virtue of their inclusion in this section. Similarly, issues identified with respect to one or more approaches should not assume to have been recognized in any prior art on the basis of this section, unless otherwise indicated.

BRIEF DESCRIPTION OF THE DRAWINGS

The present invention is illustrated by way of example, and not by way of limitation, in the figures of the accompanying drawings and in which like reference numerals refer to similar elements and in which.

DESCRIPTION OF EXAMPLE EMBODIMENTS

Figure 1:
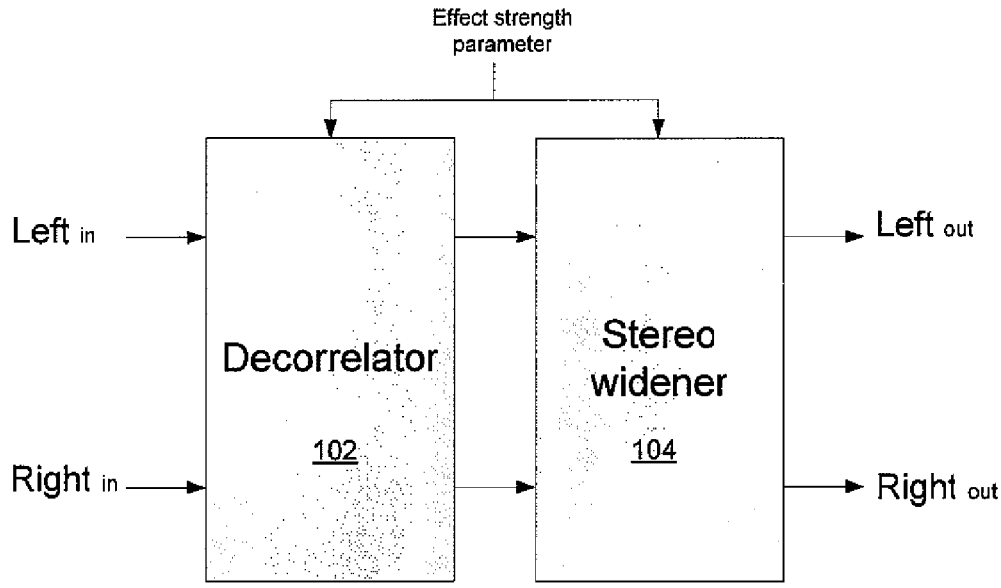
FIG. 1 depicts an example decorrelating stereo widening system, according to an embodiment of the present invention.

Stereophonic widening is described herein. In the following description, for the purposes of explanation, numerous specific details are set forth in order to provide a thorough understanding of the present invention. It will be apparent, however, that the present invention may be practiced without these specific details. In other instances, well-known structures and devices are not described in exhaustive detail, in order to avoid unnecessarily occluding, obscuring, or obfuscating the present invention.

I

Overview

Example embodiments described herein relate to stereophonic widening. Widening stereophonic response is achieved in a sound reproduction system that has two or more loudspeakers. A stereo signal input to the sound reproduction system is accessed (e.g., received and accessed), which includes multiple frequency components. The loudspeakers may be disposed in proximity to each other. A range of the stereo signal's frequency components is decorrelated. For instance, an embodiment decorrelates a relatively high frequency range, but may not decorrelate a lower frequency range. The frequency range may be decorrelated upon preprocessing the stereo signal. The stereophonic response of the sound reproduction system is widened, based on the decorrelation.

The separation of the loudspeakers may be less than ten to twenty centimeters (10-20 cm). Close loudspeaker proximity may reduce, at least in part, fullness in the stereophonic response of the sound reproduction system. However, embodiments function to allow stereophonic widening with such closely proximate speakers using decorrelation. The decorrelation may be performed as a preprocessing function performed prior to processing related to stereo widening. The frequency range may correspond to relatively high frequencies. Decorrelation may thus be performed on frequencies that exceed a threshold frequency value. In an embodiment, the threshold frequency value is within a range of frequencies that are between three-hundred Hertz (300 Hz) and three Kilohertz (3 kHz), inclusive.

Embodiments of the present invention are well suited to function with somewhat closely spaced speakers (e.g., a pair of "left" and "right" speakers separated by 20 cm or less) which, to avoid phase cancellation and produce adequate bass response for example, may be driven with respective signals that are essentially in phase at low frequencies. Decorrelating at high frequencies (e.g., above the 300 Hz-3 kHz, inclusive, cut-off frequency) may reduce some possible distracting and unwanted effects, such as may sometimes be associated with a centre image shift (e.g., center panning of audio content). Center image shifting can prevent or decrease stereo widening, and may occur with decorrelation at lower frequencies. Moreover, in as much as a spectrum of sound sources may be spread in space, lower frequencies may have a somewhat centralized location and higher frequencies, a somewhat greater spatial extension. Thus, embodiments that use high frequency decorrelation may achieve an audibly perceivable aesthetic sound quality.

Embodiments relate to a stereo widening system. FIG. 1 depicts an example stereo widening system 100, according to an embodiment of the present invention. Stereo widening system 100 has a decorrelating filter module (decorrelator) 102, which pre-processes a stereo signal for widening. The stereo signal input may include several signal components, which may include a right channel audio input component and a left channel audio input component.

Decorrelator 102 receives and/or accesses a left channel audio input and a right channel audio input. Decorrelator 102 performs decorrelation on frequencies that exceed a threshold frequency value. Decorrelation of lower frequencies may not be performed. In an embodiment, the threshold frequency value is within a range of frequencies that are between 300 Hz and 3 kHz, inclusive.

Decorrelator 102 further receives and/or accesses an effect strength parameter input signal. The effect strength parameter input signal may relate to a degree of decorrelation (e.g., decorrelation strength) and/or scaling gains, associated for example with channels or components of system 100. For instance, increasing strength of decorrelation between the left and right channels may increase energy associated with the difference channel energy and thus, may strengthen of the stereo widening effectiveness of system 100. Decorrelator 102 outputs a decorrelated audio signal to stereo widener module 104.

Widening module (widener) 104 receives and/or accesses the decorrelated output of decorrelator 102. Widener 104 performs processing that relates to widening the stereo signal. Widener module 104 generates a widened output stereo signal from the original stereo input signal. Thus, the stereo output signal may include a right channel audio output component and a left channel audio output component.

Widener module 104 further receives and/or accesses an effect strength parameter input signal. The effect strength parameter input signal may relate to scaling gains, associated with channels or components of system 100 and/or decorrelation strength. For example, scaling gains may relate to sum and difference channels. Boosting the difference channel relative to the sum channel may be used to widen the stereo field.

Embodiments of the present invention may be implemented, used, deployed and/or disposed with a variety of electronic audio devices and apparatus, such as mobile phones and portable devices. Embodiments may function to significantly increase the width of a stereo image presented with electronic audio devices which may for instance have relatively narrowly speaker spacing (e.g., expected speaker separations of less than 10-20 cm) and/or a relatively low frequency roll-off (e.g., at approximately 1 kHz).

Embodiments may be implemented with one or more processors executing instructions stored with computer readable media and controlling a computer system or an essentially computerized (e.g., digital) sound reproduction, communication and networking apparatus and devices to perform the decorrelation and stereo widening functionality.

Embodiments may be implemented with circuits and devices such as an integrated circuit (IC), including (but not limited to) an application specific IC (ASIC), a microcontroller, a field programmable gate array (FPGA) or a programmable logic device (PLD). Stereo widening and decorrelating functionality associated with embodiments may accrue to aspects of the structure and design of devices such as ASICs. Alternatively or additionally, stereo widening and decorrelation functionality may be effectuated with programming instructions, logic states, and/or logical gate configurations applied to programmable ICs, such as microcontrollers, PLDs and FPGAs.

II

Example Decorrelating Stereo Widening Systems

Embodiments may function to promote decorrelation at relatively high audio frequencies, above a high-frequency threshold, where the threshold is within a range from approximately 300 Hz to 3 kHz. In an embodiment, in addition to being promoted at high frequencies, decorrelation may be optional for lower frequencies.

A. Cross-Over Filter Example

Figure 2:
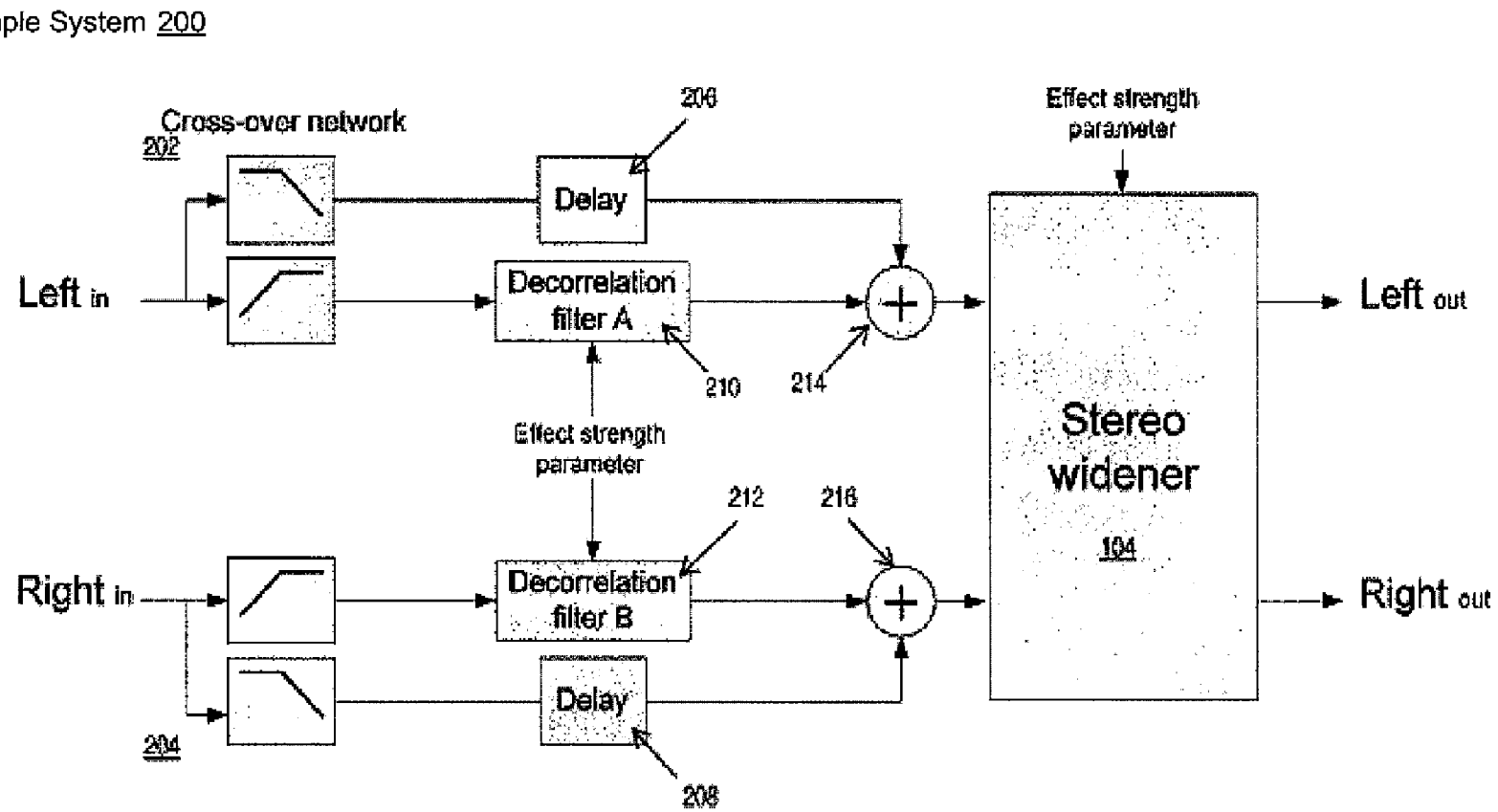
FIG. 2 depicts an example decorrelating stereo widening system with cross-over filters, according to an embodiment of the present invention.

In an embodiment, a frequency dependent decorrelator is implemented with cross-over filter networks (cross-over filters), which may act on left and right audio input signals. FIG. 2 depicts an example decorrelating stereo widening system 200 with cross-over filters 202 and 204, according to an embodiment of the present invention. System 200 receives and/or accesses left and right audio inputs. System 200 accesses a left channel audio input with cross-over filter 202. System 200 accesses a right channel audio input with cross-over 204.

Cross-over filters 202 and 204 divide the audio spectrums associated with the left and right channel inputs, respectively, into multiple frequency bands. Cross-over filters 202 and 204 may be effectuated with active high-pass and low-pass filters. High-pass filter components pass frequencies that exceed a pre-determined crossover point frequency value and attenuate frequencies below that value. Low-pass filter components pass frequencies below the crossover point and attenuate frequencies above that value.

Cross-over filters 202 and 204 respectively function to separate the left and right audio inputs into low and high frequency components. In an embodiment, cross-over filters 202 and 204 may be similar (or essentially identical). For instance, the cross-over point of each of the networks 202 and 204 may both be implemented at 1 kHz. The high-passed outputs of cross-over filters 202 and 204 provide inputs to a first decorrelator 'A' 210 and a second decorrelator 'B' 212, respectively. Decorrelator A 210 and decorrelator B 212 may have similar structural features and/or other characteristics. Importantly however, decorrelators 210 and 212 may function with different operating characteristics. For instance, decorrelator 210 may decorrelate to a greater (or less) degree than decorrelation performed by decorrelator 212. For instance, decorrelator 210 may decorrelate according to a first value g for a multiplication parameter, while decorrelation performed by decorrelator 212 may decorrelate with a second value for multiplication parameter g', e.g., as described in Equation 1 with reference to FIG. 6 and FIG. 7, below.

The output of the low pass filter component of cross-over filter 202 is supplied to a delay element 206. The output of the low pass filter component of cross-over filter 204 is supplied to delay element 208. Delay elements 206 and 208 may impose similar delays.

The output of the high pass filter component of cross-over filter 202 is supplied to decorrelation filter (decorrelator) 210. The output of the high pass filter component of cross-over filter 204 is supplied to decorrelator 212. Decorrelators 210 and 212 perform decorrelation on at least frequencies that exceed the crossover threshold frequency value. Decorrelation of lower frequencies is optional. While the decorrelators may operate across all frequencies, the cross-over filters may function to bypass the decorrelators at the low frequencies. The two decorrelators are used to provide respective outputs that are decorrelated with respect to each other, so that the output of decorrelator 210 is decorrelated from the output of decorrelator 212. It should be appreciated that the degree to which the outputs of each of decorrelator 210 and decorrelator 212 are decorrelated may differ and/or be variable.

Decorrelation filters 210 and 212 optionally each receive and/or access an effect strength parameter input signal. The effect strength parameter may relate to decorrelation strength. Increasing decorrelation strength between left and right channels may increase energy associated with the difference channel energy and thus, may increase stereo widening effectiveness for system 200.

The outputs of delay element 206 and decorrelation filter 210, which correspond to the left audio channel, are summed with an adder 214. The outputs of delay element 208 and decorrelation filter 212, which correspond to the right audio channel, are summed with an adder 216. Adders 214 and 216 each output decorrelated signals, which provide an input to stereo widener 104, which may function essentially as described above (e.g., with reference to FIG. 1). Widener module 104 thus generates widened left and right channel output stereo signals, which correspond to the respective decorrelated stereo input signals.

B. Phase Correction Filter Example

Figure 3:
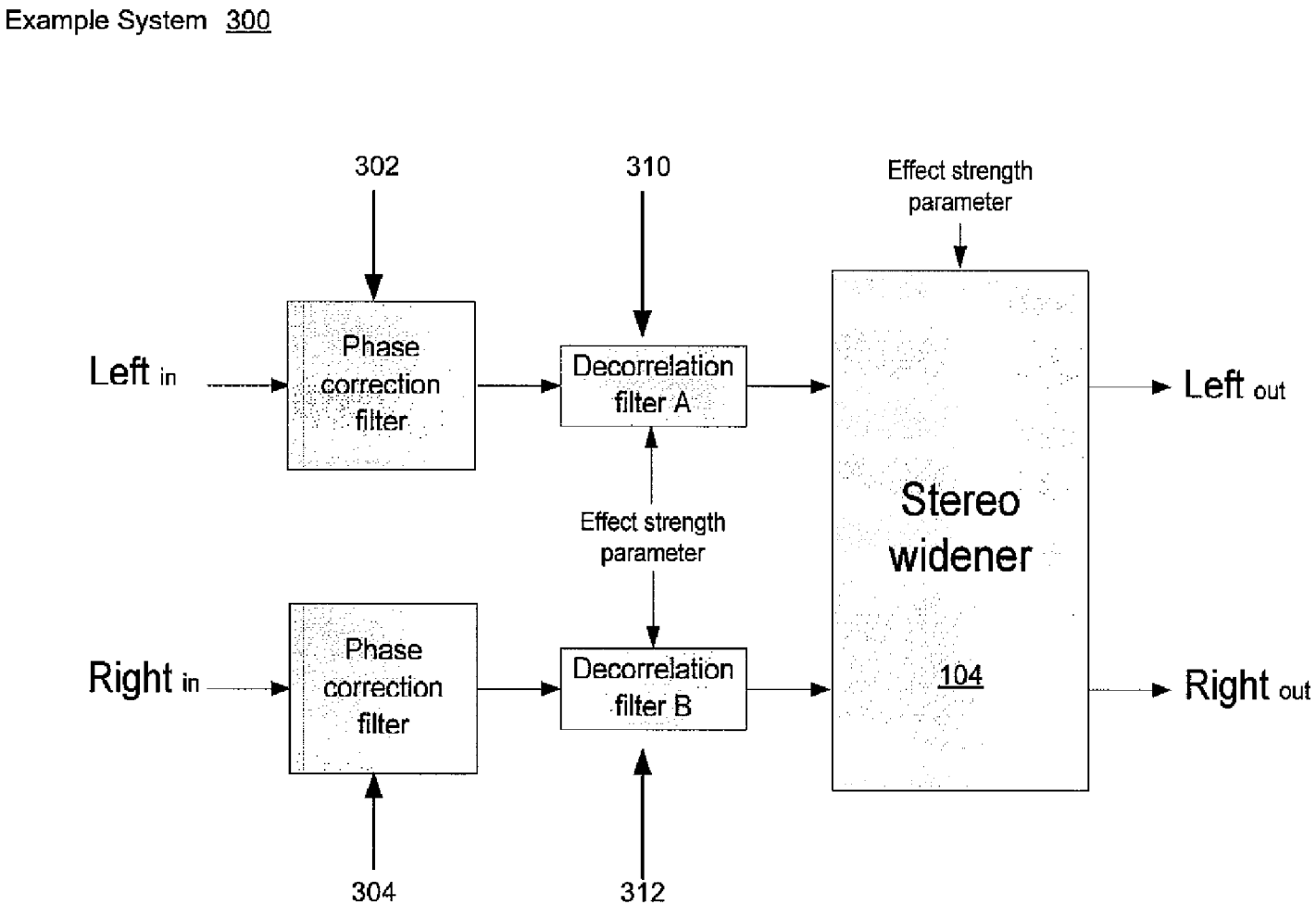
FIG. 3 depicts an example decorrelating stereo widening system with all-pass filters, according to an embodiment of the present invention.

In an embodiment, a frequency related (e.g., dependent) decorrelator is implemented with phase shift filters. FIG. 3 depicts an example decorrelating stereo widening system 300 with phase shifting (e.g., phase correction) filters 302 and 304. As used herein, the terms "phase shift" and "phase correction" may be used interchangeably in reference to filters. In an embodiment, phase shift filters 302 and 304 may be implemented with all-pass filters. While one or more of phase shift filters 302 or 304 may be implemented as all-pass phase shift filters as depicted in FIG. 3, it should be appreciated by artisans skilled in fields relating to audio reproduction and stereophonics that other filters (represented herein with phase filters 302 and 304 in FIG. 3), may be used for phase correction. System 300 receives and/or accesses left and right audio inputs. System 300 accesses a left channel audio input with phase shift filter 302. System 300 accesses a right channel audio input with phase shift filter 304. Phase shift filters 302 and 304 respectively act over the left and right audio input signals to generate phase shifted audio signal outputs corresponding thereto. Phase correction filters may be used to essentially zero inter-channel phase differences at low-frequencies. An embodiment may use all-pass filters, e.g., with specific phase responses. An embodiment may use a single 'phase correction' filter on one channel to match the phase of the other channel, e.g., at low frequencies. In an embodiment, phase-correction or cross-over networks may be obviated. For instance, the decorrelators may function over a frequency range in which low frequencies are not regularly encountered. In this instance, the phase correction filters 302 and 304 shown in FIG. 3 may be considered to introduce no phase or amplitude changes, to be optional, or to be not present. Phase correction filters 302 and 304 may allow frequency selective decorrelation without cross-over filters.

A phase shifted audio signal is provided by phase shift filter 302 to a first decorrelation filter (decorrelator) 'A' 310. A phase shifted audio signal is provided by phase shift filter 304 to a second decorrelator 'B' 312. Decorrelator A 310 and decorrelator B 312 may have similar structural features and/or other characteristics. Importantly however, decorrelators 310 and 312 may function with different operating characteristics. For instance, decorrelator 310 may decorrelate to a greater (or less) degree than decorrelation performed by decorrelator 312. For instance, decorrelator 310 may decorrelate according to a first value g for a multiplication parameter, while decorrelation performed by decorrelator 312 may decorrelate with a second value for multiplication parameter g', e.g., as described in Equation 1 with reference to FIG. 6 and FIG. 7, below. Decorrelators 310 and 312 perform decorrelation at least at frequencies that exceed a threshold frequency value. Phase shift filter 302 may function with decorrelator 310, and phase shift filter 304 may function with decorrelator 312, to result in a combined effect that matches closely over a range of frequencies below a threshold, where the threshold is between 300 Hz and 3 kHz.

Decorrelators 310 and 312 each receive and/or access an effect strength parameter input signal. The effect strength parameter may relate to decorrelation strength. Increasing decorrelation strength between left and right channels may increase energy associated with the difference channel energy and thus, may increase stereo widening effectiveness for system 300. Optionally, the affect strength parameter may also be supplied as an input to the phase shift filters 302 and 304.

The output signal of decorrelation filter 310, which corresponds to the left audio channel, and the output of decorrelation filter 312, which corresponds to the left audio channel, function as inputs to stereo widener 104. Stereo widener 104 may function essentially as described above (e.g., with reference to FIG. 1). Widener module 104 thus generates widened left and right channel output stereo signals, which correspond to the respective decorrelated stereo input signals.

C. Cross-Over Action Over an Example with Sum/Difference Signals

In an embodiment, a frequency dependent decorrelator is implemented with cross-over filters, which act on sum and difference signals. Where an audio input signal is in a domain associated with sums and differences (a "sum/difference domain"), the signal may be subjected to additional preprocessing, such as may relate to conversion, transformation or the like. For instance, an input signal in the sum/difference domain may be converted to a domain associated with audio directionality (e.g., left and right directions; a "left/right domain"), prior to decorrelation. In an embodiment, the stereo widener module is implemented in the sum/difference domain. In an additional (or alternative) embodiment, the stereo widener module is implemented in the left/right domain.

Figure 4:
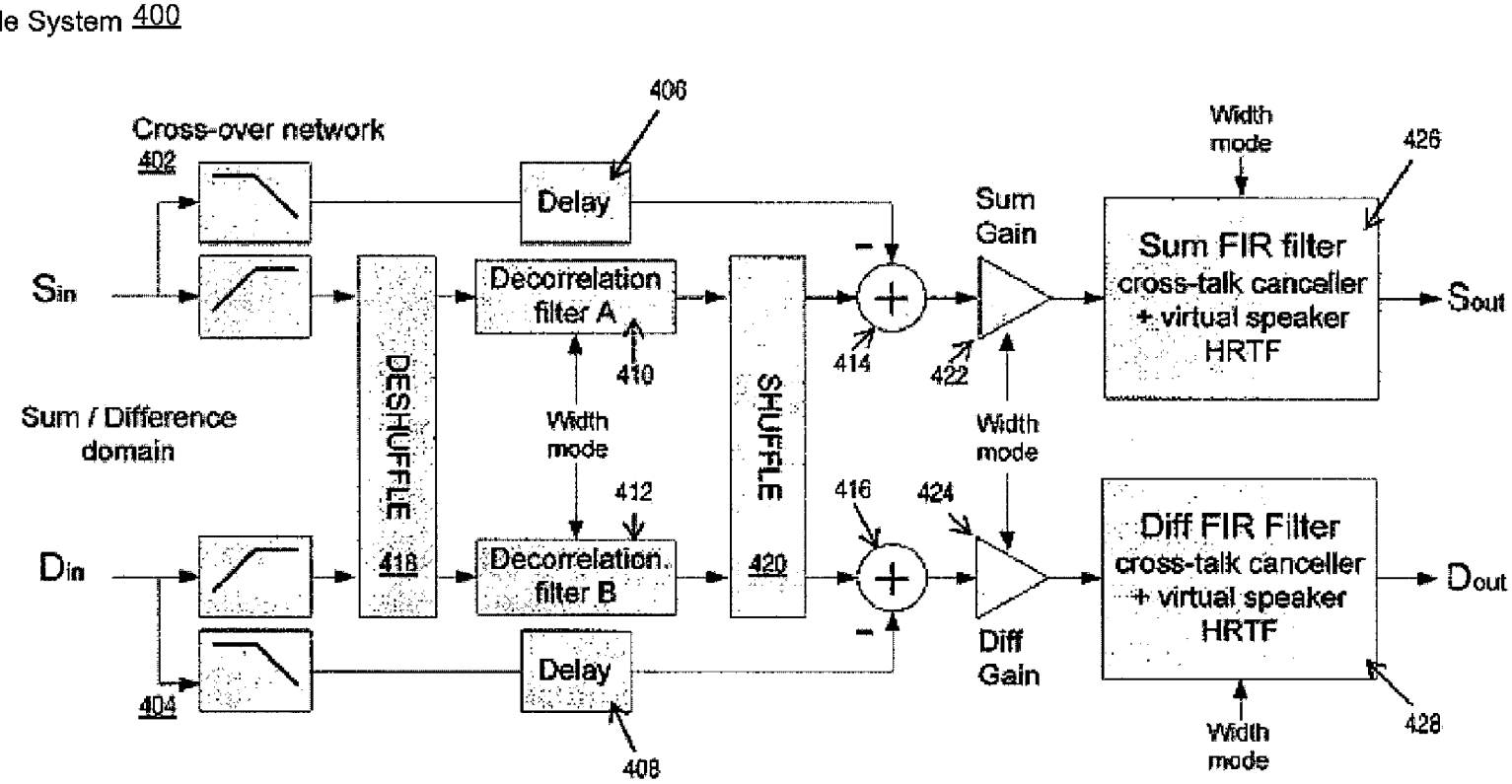
FIG. 4 depicts an example decorrelating stereo widening system that also uses cross-over filters, according to an embodiment of the present invention.

FIG. 4 depicts an example decorrelating stereo widening system 400 that also uses cross-over filters, according to an embodiment of the present invention. System 400 receives and/or accesses audio inputs in a sum and difference domain. System 400 accesses a sum channel audio input with cross-over filter 402. System 400 accesses a difference channel audio input with cross-over filter 404.

Cross-over filters 402 and 404 divide the audio spectrums associated with the sum and difference channel inputs, respectively, into multiple frequency bands. Cross-over filters 402 and 404 may be effectuated with active high-pass and low-pass filters. High-pass filter components pass frequencies that exceed a pre-determined crossover point frequency value and attenuate frequencies below that value. Low-pass filter components pass frequencies below the crossover point and attenuate frequencies above that value.

Cross-over filters 402 and 404 respectively function to separate the sum and difference audio inputs into low and high frequency components. In an embodiment, cross-over filters 402 and 404 may be similar (or essentially identical). For instance, the cross-over point of each of the networks 402 and 404 may both be implemented at 1 kHz. The high-passed output signals of cross-over filters 402 and 404 may be processed somewhat differently from the low-passed output signals thereof.

The output of the low pass filter component of cross-over filter 402 is supplied to a delay element 406. The output of the low pass filter component of cross-over filter 404 is supplied to delay element 408. Delay elements 406 and 408 may impose similar delays.

As used herein, the term "shuffle" may refer to accessing (e.g., receiving and accessing) two stereo signals, e.g., left and right, and generating therewith corresponding sums and differences (e.g., sum and difference signals). As used herein the term "shuffler" may refer to a component (e.g., of a stereo widening system) that performs such a shuffling function. As used herein, the term "deshuffle" may refer to accessing (e.g., receiving and accessing) two previously shuffled signals, e.g., sums and differences, and restoring them to left and right (or other spatially oriented) signals. As used herein the term "deshuffler" may refer to a component (e.g., of a stereo widening system) that performs such a deshuffling function. The high-pass filtered outputs of cross-over filters 402 and 404 are supplied to deshuffler module (deshuffler) 418. Deshuffler 418 essentially converts (e.g., transforms) the high-pass filtered sum and difference signals from each of the cross-over filters 402 and 404 (at least temporarily) into the left and right domain. Deshuffler 418 thus provides deshuffled signals, corresponding to each of the high-passed sum and difference inputs, to a first decorrelation filter (decorrelator) 'A' 410 and a second decorrelator 'B' 412. Decorrelator A 410 and decorrelator B 412 may have similar structural features and/or other characteristics. Importantly however, decorrelators 410 and 412 may function with different operating characteristics. For instance, decorrelator 410 may decorrelate to a greater (or less) degree than decorrelation performed by decorrelator 412. For instance, decorrelator 410 may decorrelate according to a first value g for a multiplication parameter, while decorrelation performed by decorrelator 412 may decorrelate with a second value for multiplication parameter g', e.g., as described in Equation 1 with reference to FIG. 6 and FIG. 7, below.

With respect to the effect strength parameter inputs to decorrelators 410 and 412, embodiments may implement a user controllable input that affects a mode related to stereo field width. Two or more width mode levels, including for instance half mode and full mode levels, may be selectively implemented. The width mode inputs may adjust decorrelation strength. Increasing decorrelation strength between left and right channels may increase energy associated with the difference channel energy and thus, may be used with system 400 to widen the stereo field. In a left/right domain implementation, more decorrelation between left and right channels also increases the energy of the difference channel energy and thus, the strength of the stereo widening effect.

Decorrelators 410 and 412 perform decorrelation at least on frequencies that exceed a threshold frequency value. Decorrelation of lower frequencies is optional. In an embodiment, the threshold frequency value is within a range of frequencies that are between 300 Hz and 3 kHz, inclusive. The output signal of decorrelation filter 410, which corresponds to the left signal and the output of decorrelation filter 412, which corresponds to the right signal, are provided to reshuffling module (shuffler) 420.

Shuffler 420 processes the decorrelated left/right signals to generate decorrelated sum and difference signals therewith. Shuffler 420 provides the decorrelated sum signal to adder 414 and the decorrelated difference signal to adder 416.

The delayed, low-frequency filtered sum input signals from delay element 406 are re-injected, with a phase shift of 180° (degrees) to the decorrelated, re-shuffled sum signal at adder 414. The delayed, low-passed difference input signals from delay element 408 is re-injected, with a 180° phase shift, to the decorrelated, re-shuffled difference signal at adder 416. The phase shifts may approximate 180°. The phase shifts are thus substantially out of phase. Adder 414 provides the signals combined therewith to a sum multiplier 422. Adder 416 provides the signals combined therewith to a difference multiplier 424. The 180° phase shifts are selected so that the low-pass filtered signal components re-combine with the decorrelated high-pass filtered signal components with maximum phase-matching, at the crossover frequency. Other choices of phase shift (including the use of no phase shift) may be appropriate in other circumstances where the behavior of the decorrelation filters is different at the crossover frequency. The choice of a suitable phase shift may be performed by listening tests, where choices may be made on the basis of subjective sound quality.

Sum multiplier 422 and difference multiplier 424 each scale, attenuate, or add gain to the combined sum and difference signals provided with adder 414 and adder 416, respectively. For instance, boosting the difference channel and reducing the sum channel can be used to widen the stereo field. The sum signal from sum multiplier 422 is provided to a sum finite impulse response (FIR) filter 426. The difference signal from difference multiplier 424 is provided to a difference FIR filter 428.

An effect strength parameter input may also be accessed by each of the multipliers 422 and 424 and by each of the FIR filters 426 and 428. Embodiments may implement a user controllable input that affects a mode related to stereo field width. Two (or more) width mode levels that include half mode and full mode levels may be selectively implemented. The width mode inputs may adjust gains of sum and difference channels, as well as the impulse response or other features or functions of FIR filters 426 and 428. Importantly, the gains applied to the sum and difference may differ.

FIR filter 426 functions over the modified sum signal. FIR filter 428 functions over the modified difference signal. Moreover, each of FIR filters 426 and 428 function to provide cross-talk cancellation and speaker virtualization. FIR filters 426 and 428, together with cross-talk cancellation function to allow listeners to perceive left and right signals as emanating from outside the space between the two loudspeakers.

D. Example FIR Filters

Figure 5:
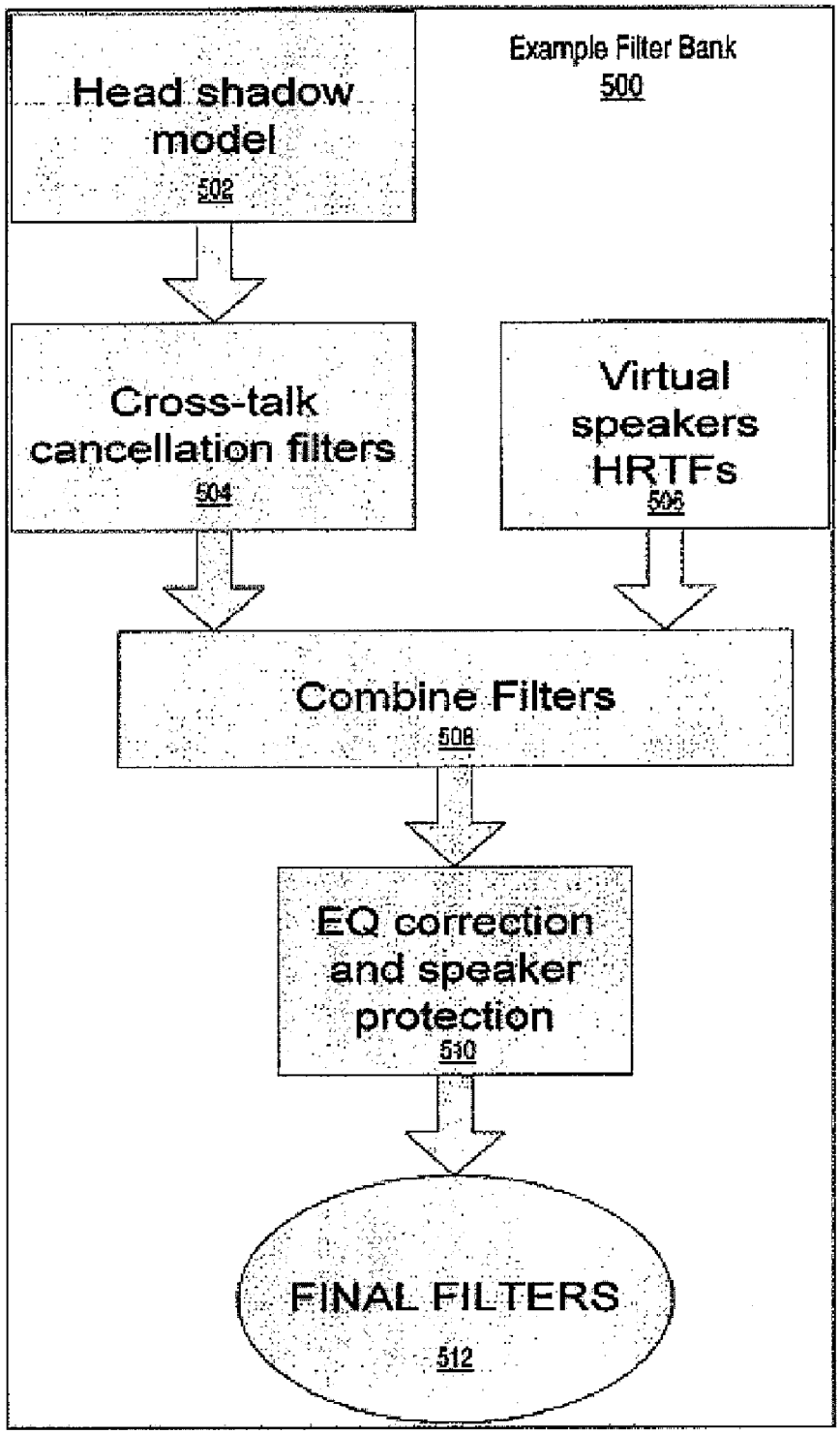
FIG. 5 depicts an example filter bank, according to an embodiment of the present invention.

FIG. 5 depicts example filter data flow 500, according to an embodiment of the present invention. The generation of the FIR filter (FIG. 4) coefficients for the sum and difference channels may thus be depicted. Cross-talk cancellation filters 504 may be implemented with a head shadow model 502. In an embodiment, cross-talk cancellation filters 504 may be based on cross-talk cancellation techniques, which should be familiar to artisans skilled in arts relating to audio technology in general and stereophonics in particular as at least similar to cross-talk cancellation techniques such as those proposed or implemented by Schroeder.

Head related transfer functions (HRTF) 506, which correspond to virtual speakers placed in front of the listener and spaced by 90°, may be superimposed on cross-talk cancellation filters 506. Importantly, cross-talk cancellation filters 504 and HRTF filters 506 may be functionally combined or cascaded in a filter combiner 508. The combined filters provide an input to equalization correction and loudspeaker protection (EQ) 510.

EQ 510 provides the equalized, combined features of cross-talk cancellation filters 504 and HRTF filters 506 to final filters 512. Final filters 512 may attenuate low frequency components (e.g., components with frequency values below 200 Hz), which may accord some protection to loudspeakers from low frequencies. Low frequencies may be difficult to reproduce with speakers of relatively small size, power handling capacity or other diminutive characteristics, and may prevent result in distortion or overload.

Frequency Based Decorrelation Example

Embodiments may implement the frequency based (e.g., frequency dependent) decorrelation techniques as described herein with various methods and techniques with which relatively high frequencies are decorrelated. In an embodiment, relatively high frequencies are decorrelated while, essentially simultaneously, low frequencies are kept in phase. To achieve frequency dependent decorrelation, an embodiment uses cross-over filters with decorrelation filters, as in examples depicted herein (e.g., with reference to FIG. 2 and FIG. 4). Alternatively, an embodiment may achieve frequency dependant decorrelation by removing or reducing the decorrelation in low-frequencies by the use of compensating correction filters, e.g., as shown in FIG. 3.

Figure 6:
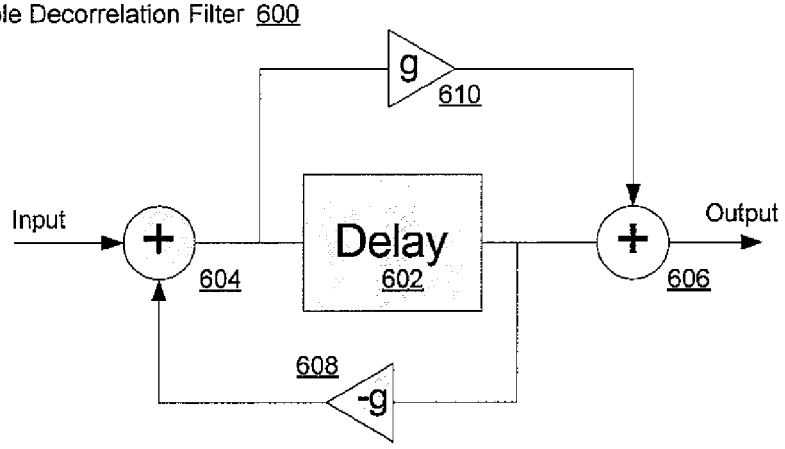
FIG. 6 depicts an example decorrelation filter, according to an embodiment of the present invention.

Embodiments may use all-pass decorrelation that may selectively or exclusively affect the phase of the signal. FIG. 6 depicts an example decorrelation filter 600, according to an embodiment of the present invention. Decorrelation, as described herein may be relatively or significantly efficient from a computational perspective. For instance, decorrelators described herein may function with two (2) taps (e.g., 2 multiplications, 2 additions) and a delay line, provided with a delay element 602. Adder 604 accesses an input to decorrelator 600.

Adders 604 and 606 may perform the additions. Multipliers 608 and 608 may perform the multiplications. Multiplier 610 shares an input with delay element 602 and provides an output to adder 606 therewith. The output of delay element 602 also provides an input to multiplier 608. Adder 606 receives an audio input and an input from the output of multiplier 608 from delay element 602. Adder 606 provides an output from decorrelator 600.

In an embodiment, a transfer function H(z) of the decorrelation filters may be described according to Equation 1, below.

$$H(z) = \frac{g + Z^{-N}}{1 + g \cdot Z^{-N}} \qquad \text{(Equation 1.)}$$

In Equation 1, g is a real number in the range corresponding to [−1, 1] and represents a value associated with a function of multipliers 608 and 610, and N represents a delay value that may be associated with delay element 602. For instance, an implementation with a delay value that corresponds to 25 samples, taken over a signal with a frequency of 48 kHz, generates sufficient phase change over higher frequencies to effectively decorrelate the audio input.

In an embodiment, similar decorrelators that function with different values for g, or different decorrelation filters may be used on the left and right (or sum and difference) channels. For instance, each of the decorrelators in the decorrelator pairs 210 and 212, 310 and 312, or 410 and 412 above (respectively described herein with reference to FIGS. 2, 3 and 4) may function with a value g and the other decorrelator in each pair may function with the value of g'. One or more of decorrelators 210, 310 or 410 may function with the value g and one or more of decorrelators 212, 312 or 412 may function with the value g'. Each of the decorrelators 210 and 212, 310 and 312, or 410 and 412 may have similar structural features and other characteristics. Importantly however, they may each function with different operating characteristics than the other decorrelator within each stereo widening system. Where the absolute value |g−g'|=0 (zero), essentially no decorrelation may occur. As g is a real number in the range of [−1, 1] over Equation 1, where |g−g'|=2 (two), the degree of decorrelation may be maximized. Significant decorrelation may be present with values of |g−g'| over a range of between 0.8 and 1.6. In an embodiment, similar (or equal) delay lengths may be associated with each of the decorrelators, which may allow uniform and essentially constant phase wrapping (e.g., over a linear scale). An embodiment may function with decorrelators having substantially equal delays and substantially equal, but oppositely signed values for g and for g', one sign positive and the other negative. In an embodiment, one (or the other) of the decorrelators in each system may effectively be substituted (e.g., replaced) with a delay function, in which case frequency related phase shifting may be performed in the sole decorrelator. Decorrelation filtering left and right audio input channels differently creates phase differences across frequency. By using different values for g (or g'), different phase responses may be obtained for the left and right (or sum and difference domain) channels. Varying the phase response of the right and left channels may produce inter-channel decorrelation.

Figure 7:
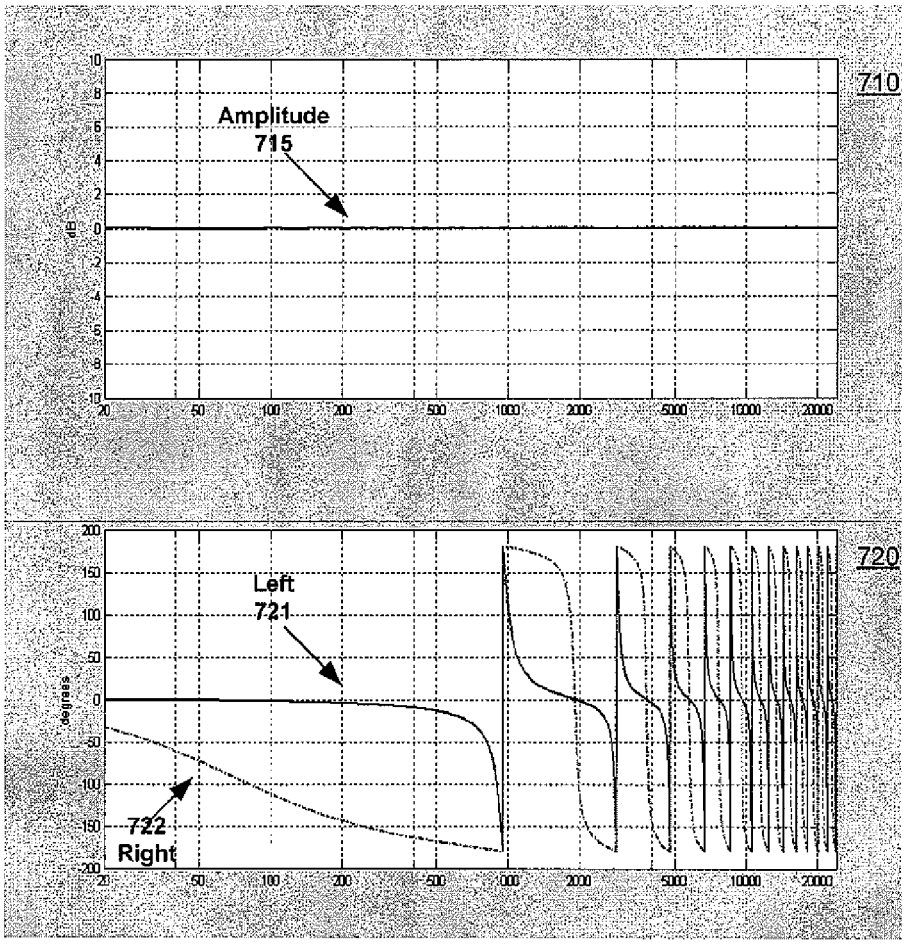
FIG. 7 depict screenshots of amplitude and phase responses, in an example implementation.

FIG. 7 depicts screenshots 700 of amplitude and phase responses, in an example implementation. Screenshots 700 include an amplitude response trace 710 and a phase response plot 720, for the left and right channels (721 and 722 respectively), over a decorrelation implementation, in which the values g in Equation 1 correspond to g=0.8 for the left channel decorrelator, and to g=−0.8 for the right channel decorrelator. In trace 710, the amplitude response 715 runs at approximately zero decibels (dB) over substantially the entire frequency range, for both left and right channel responses. In plots 720, trace 721 corresponds to the left audio channel and trace 722 corresponds to the right audio channel. Traces 721 and 722 show that the left and right channels may share a decorrelation crossover point at a frequency value of approximately 1 kHz.

In an embodiment, the degree of decorrelation may be controlled by changing the coefficients g and g' associated with multipliers 608 and 610. Changing the "g" coefficients may affect the phase difference between channels. Effect strength parameters and width modes, as described herein, may be associated with changes to the gain coefficients of amplifiers 608 and 610. Thus, an embodiment may function to control the amount (e.g., strength) of decorrelation by changing the value of the gain coefficients. For instance, a selectable (e.g., programmable, adjustable) width mode may thus be implemented.

Figure 8:
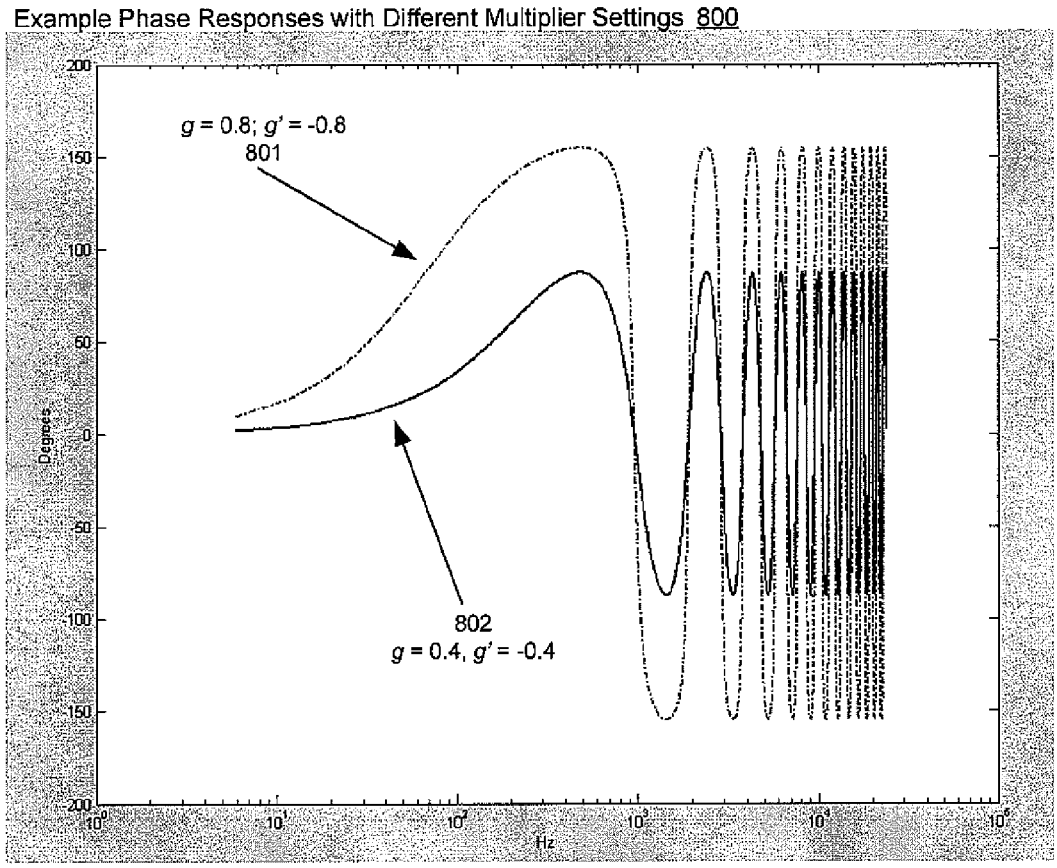
FIG. 8 depicts a screenshot that plots a phase response difference between audio channels at different gain settings, in an example implementation.

FIG. 8 depicts a screenshot 800 that plots a phase response difference between left and right channels at different gain settings, in an example implementation. Trace 801 plots an example phase response difference between the audio channels with value settings for g of 0.8 for the left channel and −0.8 for the right channel. Trace 802 plots an example phase response difference between the audio channels with gain value settings of 0.4 for the left channel and −0.4 for the right channel. Trace 801 may thus represent a "full width mode" phase response. Trace 802 may thus represent a "half width mode" phase response. Trace 801 and trace 802 each share a cross-over point at 1 frequency value of approximately 1 kHz.

Example Cross-Over Filters

Figure 9:
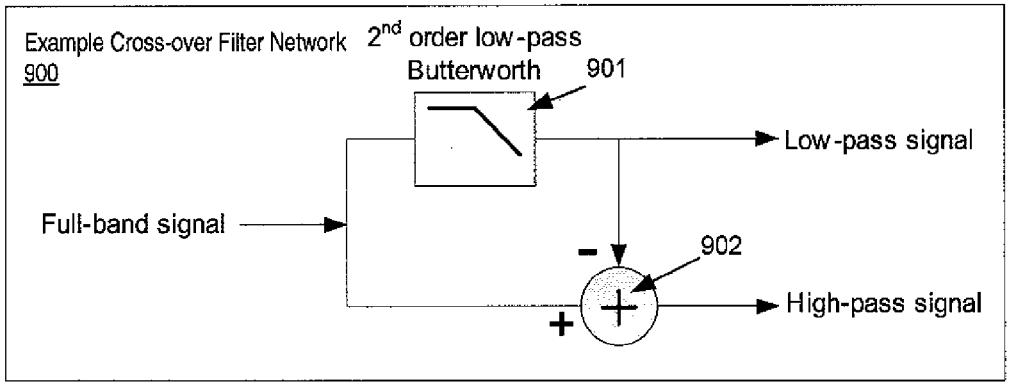
FIG. 9 depicts an example cross-over filter, according to an embodiment of the present invention.

Embodiments may use cross-over filter networks (e.g., cross-over filters 202, 204 and 402, 404; FIG. 2 and FIG. 4, respectively), which may separate relatively high frequency range components and relatively low frequency range components (e.g., prior to decorrelation of the high frequency components). FIG. 9 depicts an example cross-over filter 900, according to an embodiment of the present invention.

Cross-over filter 900 receives and/or accesses a full-band audio input signal. The input signal may be provided to an infinite impulse response (IIR) filter 901 and to a mixer (adder) 902. Filters with other than IIR characteristics may also be used, such as may give rise to steeper filter skirts and concomitantly less overlap. In an embodiment, IIR filter 901 is implemented as a second order IIR filter. In an embodiment, IIR filter 901 is implemented with Butterworth characteristics. In an embodiment, IIR filter 901 is implemented as a second order Butterworth filter. The IIR filter may also be implemented with Chebyshev, Bessel, elliptic or other IIR characteristics. Using a single second order IIR filter 901 and a single mixer 902 in an embodiment may conserve computational resources associated with implementing cross-over filter 900. Cross-over filter 900 splits the full-band input signal into low-pass and high-pass signal components.

Figure 10:
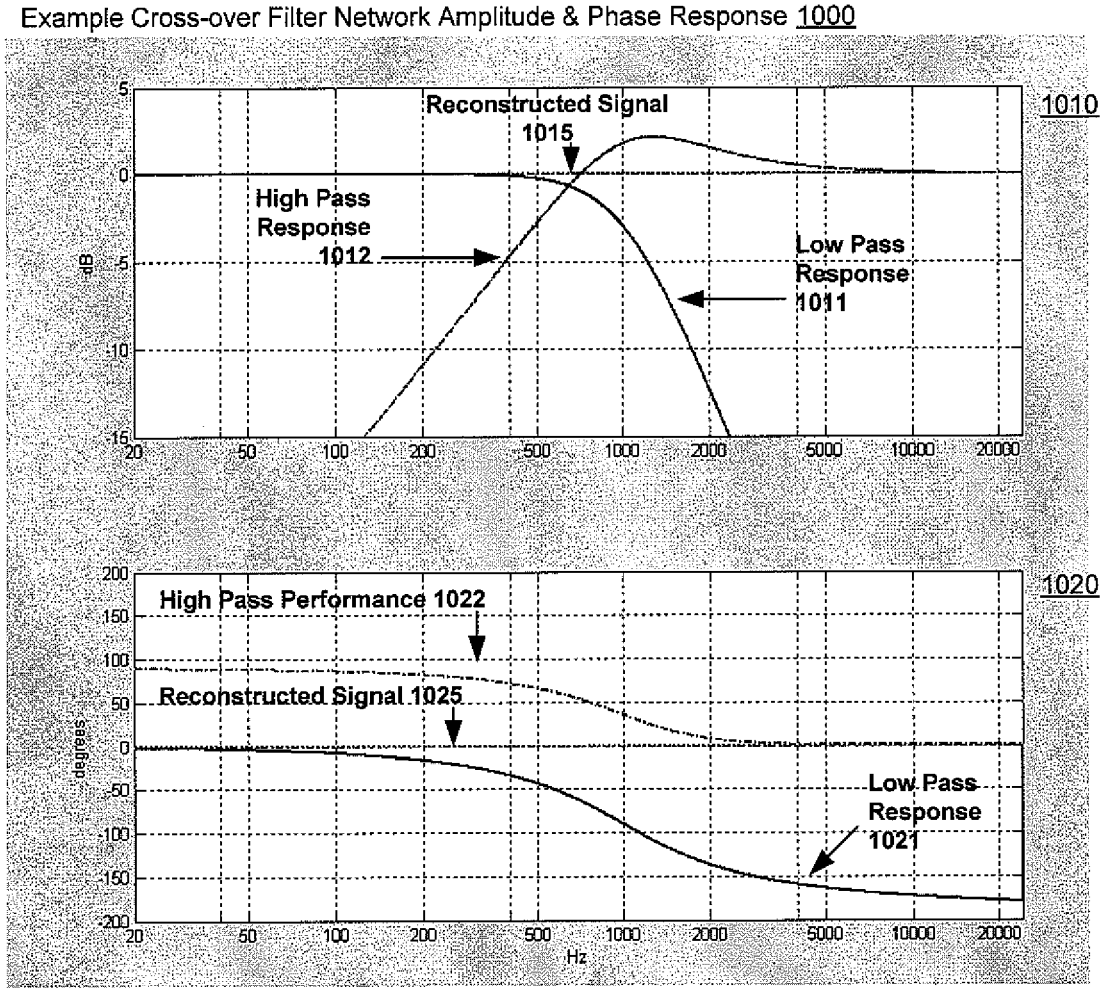
FIG. 10 depicts screen shots of amplitude and phase response plots associated with a cross-over filter, in an example implementation.

FIG. 10 depicts screen shots 1000 of amplitude and phase response plots associated with a cross-over filter, in an example implementation. Screenshots 1000 include an amplitude plot 1010 and a phase response plot 1020. Amplitude plot 1010 includes a low-pass response trace 1011, a high-pass response trace 1012, and a trace 1015, which corresponds to the reconstructed signal. Phase response plot 1020 includes a low-pass response trace 1021, a high-pass response trace 1022, and a trace 1025, which corresponds to the reconstructed signal.

The high-pass filter response may approach a first-order slope. Embodiments may use a relatively high frequency value for a cross-over point. Thus, a high-pass filter response that approaches a first-order slope may suffice in the context of implementing decorrelation therewith.

Figure 11:
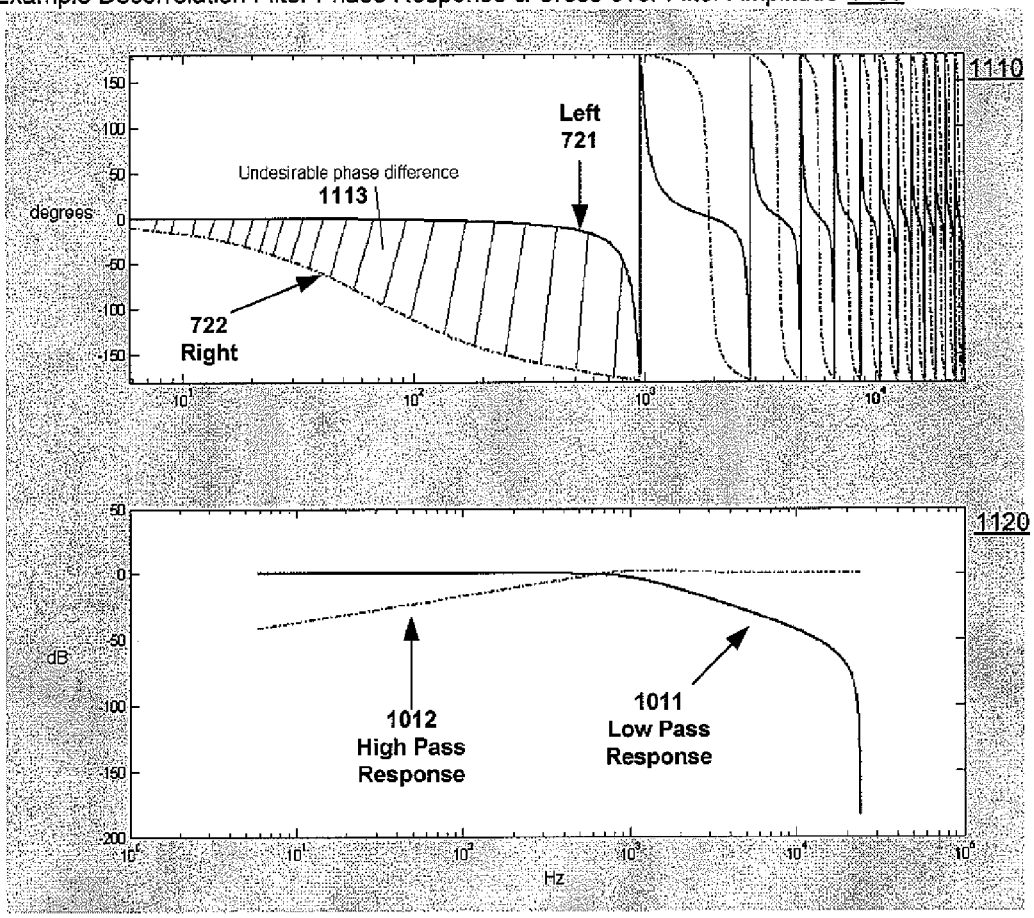
FIG. 11 depicts screen shots of a phase response and amplitude plots, respectively associated with a decorrelation filter and a cross-over filter, in an example implementation.

FIG. 11 depicts a split screen shot 1100 of phase response and amplitude plots, respectively associated with a decorrelation filter and a cross-over filter, in an example implementation. Screen shot segment 1110 plots phase responses associated with an example decorrelator in left channel trace 721 and right channel trace 722 (FIG. 7).

Embodiments may use decorrelation filters implemented with a substantially linearly spaced phase wrapping period. Plotted logarithmically, high-frequency phase differences may change more rapidly at relatively higher frequencies than at relatively lower frequencies.

Frequencies below 1 kHz are substantially out of phase in plot 1110. From a psychoacoustic perspective, decorrelated and out of phase left and right low frequency signals may be perceived by human listeners, e.g., with substantially normal binaural hearing, as somewhat weakened bass content. Weakened bass content may result, at least in part, from cancellation of bass frequencies through destructive interference that may result from the out of phase channel content. Moreover, a position of a phantom (e.g., virtual) soundstage center may be perceived as shifted to one side (or another). Shifting the soundstage center may be perceived to cause a somewhat unnatural listening experience. Thus, a range of undesirable phase differences 1113 may occur at frequencies below 1 kHz.

An embodiment functions to decorrelate relatively high frequencies and to reduce, minimize, or prevent decorrelation of relatively low frequencies. An embodiment may implement a cross-over point at a frequency of 1 kHz, at which the decorrelation filters' phase difference between the left and right channels may be minimum (e.g., zero or approximately zero), with a delay that corresponds to a rate of, for example, 25 samples at a 48 kHz decorrelator delay line.

The high-frequency filter component may be implemented with a first-order roll-off (or a roll-off that approximates first order). Thus, decorrelation filters may retain some effect below the cross-over frequency of 1 kHz. However, the effect of the decorrelators may decrease with frequency. In an embodiment, the decreasing decorrelation effect may be significant (e.g., perhaps substantial) with decreasing frequencies.

At 1 kHz, the left and right decorrelator outputs may substantially be in phase. However, at 1 kHz, the left and right decorrelator outputs may be 180° (or approximately so) out of phase, with respect to the decorrelator input. An embodiment may thus re-inject the low frequencies essentially out of phase after decorrelation (e.g., with mixers 214, 216 and/or 414, 416; FIG. 2 and FIG. 4, respectively).

An embodiment may thus widen (extend the stereo image width) of audio content reproduced with loudspeakers that are separated by relatively small distances, such as less than 10 cm. Stereo widening, according to an embodiment, may thus be economically used with apparatus and devices such as mobile phones, personal digital assistants, portable sound reproduction devices such as MP3 players (or players of audio content related to other codecs or conforming to other formats) and game devices, other entertainment related or portable devices, laptop and palmtop computers, and the like. In an embodiment, filters to compensate for loudspeaker frequency response may be included with FIR filters (e.g., FIR filters 426, 428; FIG. 4). Thus, embodiments may be customized, such as for adjusting (e.g., maximizing) the stereo widening effect and/or for tailoring to a variety of handsets, headsets and the like, which may be used with mobile phones and other devices and apparatus.

III

Example Embodiments

Example embodiments of the present invention may thus relate to one or more of the example embodiments enumerated in the paragraphs below.

1. A method, comprising the steps of:

accessing an stereo signal input to a sound reproduction system that includes at least two loudspeakers;

wherein the stereo signal includes a plurality of frequency components; and wherein the at least two loudspeakers are disposed in a proximity to each other;

decorrelating a frequency range of the frequency components; and widening a stereophonic response of the sound reproduction system based on the decorrelating step.

2. The method as recited in enumerated example embodiment 1, further comprising the step of:

pre-processing the stereo signal;

wherein the pre-processing step includes the decorrelating step.

3. The method as recited in enumerated example embodiment 1 wherein the proximity corresponds to a separation of the at least two loudspeakers that, prior to the decorrelating step, at least partially reduces a fullness quality associated with the stereophonic response.

4. The method as recited in enumerated example embodiment 3 wherein the separation does not exceed twenty centimeters.

5. The method as recited in enumerated example embodiment 3 wherein the separation does not exceed ten centimeters.

6. The method as recited in enumerated example embodiment 1 wherein the frequency range corresponds to high frequencies.

7. The method as recited in enumerated example embodiment 6 wherein the decorrelating step is performed on the high frequencies that exceed a threshold frequency value.

8. The method as recited in enumerated example embodiment 7 wherein the threshold frequency value is within a range of frequency values between three-hundred Hertz (300 Hz) and three Kilohertz (3 kHz), inclusive.

9. A system, comprising:

means for accessing a stereo signal input to a sound reproduction system that includes at least two loudspeakers;

wherein the stereo signal includes a plurality of frequency components; and wherein the at least two loudspeakers are disposed in a proximity to each other;

means for decorrelating a frequency range of the frequency components; and means for widening a stereophonic response of the sound reproduction system based on a function of the decorrelating means.

10. The system as recited in enumerated example embodiment 9, further comprising:

means for pre-processing the stereo signal;

wherein the pre-processing means includes the decorrelating means.

11. The system as recited in enumerated example embodiment 10 wherein the pre-processing means further comprises means for filtering the stereo signal input.

12. The system as recited in enumerated example embodiment 11 wherein the filtering means comprises at least one of:

a cross-over filter; or a phase correction filter;

wherein the filtering means separate the decorrelation frequency range from another frequency range.

13. The system as recited in enumerated example embodiment 12 wherein:

the other frequency component comprises a frequency component that has a frequency value below that of the decorrelation frequency range; and wherein the pre-processing means further comprises means for adding a delay to the frequency value that is below that of the decorrelation frequency range.

14. The system as recited in enumerated example embodiment 13 wherein the system functions over one or more of:

a domain that is based on directionality components that are associated with the stereo input; or a domain that is based on sums and differences, which are associated with the stereo input.

15. The system as recited in enumerated example embodiment 14 wherein, for a domain that is based on sums and differences associated with the stereo input, the system further comprises:

means for deshuffling the stereo input prior to a function of the decorrelating means into the directionality based domain.

16. The system as recited in enumerated example embodiment 15 wherein the system further comprises:

means for reshuffling a decorrelated signal from the decorrelating means back into the sums and differences domain.

17. The system as recited in enumerated example embodiment 16, further comprising:

means for mixing a reshuffled signal from the reshuffling means with the delayed frequency value, which is below that of the decorrelation frequency range.

18. The system as recited in enumerated example embodiment 17 wherein the mixing means function to mix the delayed frequency value, which is below that of the decorrelation frequency range, with a 180 degree phase shift relative to the reshuffled signal.

19. The system as recited in enumerated example embodiment 17, further comprising:

means for scaling a mixed signal from the mixing means.

20. The system as recited in one or more of enumerated example embodiment 9 or enumerated example embodiment 19, wherein the widening means comprise a widening filtering means.

21. The system as recited in enumerated example embodiment 20 wherein the widening filtering means comprises a finite impulse response filter.

22. The system as recited in enumerated example embodiment 20 wherein the widening filtering means comprises one or more of:

means for cancelling a cross-talk component associated with at least two signals processed with the system;

means for virtualizing a speaker array; or means for responding to a head related transfer function.

23. The system as recited in enumerated example embodiment 22 wherein the widening filtering means further comprises one or more of:

a head shadow model; or an equalization correction component.

24. The system as recited in enumerated example embodiment 11 wherein the decorrelating means comprises:

a delay element;

a first mixer that takes an input from the filtering means;

a second mixer that takes an input from the delay element;

a first amplifier that takes an input from the first mixer; and a second amplifier that takes an input from the delay element;

wherein the first mixer mixes the input from the filtering means with an output of the second amplifier; and wherein the second mixer mixes the output from the delay element with an output of the first amplifier to generate a decorrelated signal.

25. The system as recited in enumerated example embodiment 11 wherein the filtering means comprise an infinite impulse response filter.

26. The system as recited in enumerated example embodiment 25 wherein the infinite impulse response filter comprises a Butterworth filter.

27. The system as recited in enumerated example embodiment 25 wherein the infinite impulse response filter comprises a second order Butterworth filter.

28. The system as recited in enumerated example embodiment 25 wherein the infinite impulse response filter performs a low-pass filter function.

29. The system as recited in enumerated example embodiment 28 wherein the faltering means further comprises:

a mixer that performs a high-pass filter function;

wherein the mixer mixes an output of the infinite impulse response filter substantially out of phase with the stereo input signal.

30. The system as recited in enumerated example embodiment 9 wherein the proximity corresponds to a separation of the at least two loudspeakers that, prior to a function of the decorrelating means, at least partially reduces a fullness quality associated with the stereophonic response.

31. The system as recited in enumerated example embodiment 30 wherein the separation does not exceed twenty centimeters.

32. The system as recited in enumerated example embodiment 30 wherein the separation does not exceed ten centimeters.

33. The system as recited in enumerated example embodiment 9 wherein the frequency range corresponds to high frequencies.

34. The system as recited in enumerated example embodiment 33 wherein the decorrelating means functions over the high frequencies that exceed a threshold frequency value.

35. The system as recited in enumerated example embodiment 34 wherein the threshold frequency value is within a range of frequency values between three-hundred Hertz (300 Hz) and three Kilohertz (3 kHz), inclusive.

36. A computer readable storage medium comprising instructions which, when executed with one or more processors, configure a system as recited in one or more of enumerated example embodiments 9-35.

37. A computer readable storage medium comprising instructions which, when executed with one or more processors, cause a computer system to perform steps related to stereophonic widening, wherein the steps include:

one or more of the steps recited in enumerated example embodiments 1-8.

38. An integrated circuit device configured to perform steps relating to stereophonic widening, wherein the steps comprise:

one or more steps of a method as recited in any of enumerated example embodiments 1-8.

39. An integrated circuit device configured as a stereophonic widening system, wherein the system comprises:

a system as recited in any of enumerated example embodiments 9-35.

40. The integrated circuit device as recited in one or more of enumerated example embodiments 38 or 39 wherein the integrated circuit device comprises at least one of:

a programmable logic device; or an application specific integrated circuit.

41. The integrated circuit device as recited in enumerated example embodiment 40 wherein the programmable logic device comprises at least one of:

a microcontroller; or a field programmable gate array.

42. A computer readable storage medium comprising instructions which, when executed with a processing entity, configure an integrated circuit as recited in one or more of enumerated example embodiments 38-41.

43. An apparatus configured to perform steps relating to stereophonic widening, wherein the steps comprise:

one or more steps of a method as recited in any of enumerated example embodiments 1-8.

44. An apparatus configured with a stereophonic widening system, wherein the system comprises:

a system as recited in any of enumerated example embodiments 9-35.

45. The apparatus as recited in one or more of enumerated example embodiments 43 or 44 wherein the apparatus comprises at least one of:

a communication device;

a computer device; or an entertainment device.

46. A computer readable storage medium comprising instructions which, when executed with a processing entity, control an apparatus as recited in one or more of enumerated example embodiments 43-45.

47. A method for modifying a stereo input that includes left and right input signals, to provide a widened impression when played back over a pair of loudspeakers that are less than 20 cm apart, the method comprising the steps of:

modifying said left and right input signals, with a decorrelating process, to produce a decorrelated left channel signal and a decorrelated right channel signal wherein said decorrelated left channel signal is varied in phase relative to said left input signal according to the left channel phase response, and said decorrelated right channel signal is varied in phase relative to said right input signal according the right channel phase response, modifying said decorrelated left channel signal and said decorrelated right channel signal via a stereo-widening process, and feeding outputs from said stereo widening process to the said pair of loudspeakers, wherein said left channel phase response matches closely to said right channel phase response at frequencies below a threshold frequency, and left channel phase response differs from said right channel phase at frequencies above said threshold frequency, where said threshold frequency is between 300 Hz and 3 kHz

IV

Equivalents, Extensions, Alternatives and Miscellaneous

Example embodiments for stereo widening are thus described. In the foregoing specification, embodiments of the present invention have been described with reference to numerous specific details that may vary from implementation to implementation. Thus, the sole and exclusive indicator of what is the invention, and is intended by the applicants to be the invention, is the set of claims that issue from this application, in the specific form in which such claims issue, including any subsequent correction. Any definitions expressly set forth herein for terms contained in such claims shall govern the meaning of such terms as used in the claims. Hence, no limitation, element, property, feature, advantage or attribute that is not expressly recited in a claim should limit the scope of such claim in any way. The specification and drawings are, accordingly, to be regarded in an illustrative rather than a restrictive sense.

What is claimed is:

1. A method, comprising the steps of:

accessing a stereo signal input to the sound reproduction system, which includes at least two loudspeakers;

wherein the stereo signal includes a plurality of frequency components; and wherein the at least two loudspeakers are disposed in a spatial proximity to each other;

decorrelating a high frequency range of the frequency components, wherein the decorrelated high frequency range corresponds to high frequencies above a threshold frequency, wherein said threshold frequency is between 300 Hertz and 3 Kilohertz, while not decorrelating a lower frequency range; and widening a stereophonic response of the sound reproduction system based on the decorrelating step.

2. The method as recited in claim 1, further comprising the step of:

pre-processing the stereo signal;

wherein the pre-processing step includes the decorrelating step.

3. The method as recited in claim 1 wherein the proximity corresponds to a separation of the at least two loudspeakers that, prior to the decorrelating step, at least partially reduces a fullness quality associated with the stereophonic response.

4. A sound reproduction system that receives a stereo signal input to a sound reproduction system and drives at least two loudspeakers, wherein the stereo signal includes a plurality of frequency components and wherein the at least two loudspeakers are disposed in a spatial proximity to each other the system comprising:

means for decorrelating a high frequency range of the frequency components, wherein the decorrelated high frequency range corresponds to high frequencies above a threshold frequency, wherein said threshold frequency is between 300 Hertz and 3 Kilohertz, while not decorrelating a lower frequency range;

wherein the decorrelating means comprises the receiving means or accesses the stereo input signal therefrom; and means for widening a stereophonic response of the sound reproduction system based on a function of the decorrelating means.

5. The system as recited in claim 4, further comprising:

means for pre-processing the stereo signal;

wherein the pre-processing means includes the decorrelating means; and wherein the pre-processing means further comprises means for filtering the stereo signal input.

6. The system as recited in claim 5 wherein the filtering means comprises at least one of:

a cross-over filter; or a phase correction filter;

wherein the filtering means separate the decorrelation frequency range from another frequency range.

7. The system as recited in claim 6 wherein:

the other frequency range comprises a frequency component that has a frequency value below that of the decorrelation frequency range; and wherein the pre-processing means adds a delay to the frequency value that is below that of the decorrelation frequency range.

8. The system as recited in claim 4 wherein the system functions over one or more of:

a domain that is based on directionality components that are associated with the stereo input; or a domain that is based on sums and differences, which are associated with the stereo input.

9. The system as recited in claim 8 wherein, for a domain that is based on sums and differences associated with the stereo input, the system functions to perform one or more of:

deshuffling the stereo input prior to a function of the decorrelating means into the directionality based domain;

reshuffling a decorrelated signal from the decorrelating means back into the sums and differences domain; or mixing a reshuffled signal from the reshuffling means with the delayed frequency value, which is below that of the decorrelation frequency range.

10. A method for modifying a stereo input that includes left and right input signals, to provide a widened impression when played back over a pair of loudspeakers that are less than 20 cm apart, the method comprising the steps of:

modifying said left and right input signals, with a decorrelating process, to produce a decorrelated left channel signal and a decorrelated right channel signal wherein said decorrelated left channel signal is varied in phase relative to said left input signal according to the left channel phase response, and said decorrelated right channel signal is varied in phase relative to said right input signal according to the right channel phase response, modifying said decorrelated left channel signal and said decorrelated right channel signal via a stereo-widening process, and feeding outputs from said stereo widening process to the said pair of loudspeakers, wherein said left channel phase response matches closely to said right channel phase response at frequencies below a threshold frequency, and said left channel phase response differs from said right channel phase response at frequencies above said threshold frequency, where said threshold frequency is between 300 Hz and 3 kHz.

11. A non-transitory computer readable storage medium comprising instructions, which when executed or performed by one or more processors, cause the one or more processors to perform or control a process that comprises:

accessing an stereo signal input to a sound reproduction system that includes at least two loudspeakers;

wherein the stereo signal includes a plurality of frequency components; and wherein the at least two loudspeakers are disposed in a spatial proximity to each other;

decorrelating a frequency range of the frequency components, wherein the decorrelated frequency range corresponds to high frequencies between 300 Hertz and 3 Kilohertz without substantial decorrelation of frequencies lower than the decorrelated high frequency range and wherein the decorrelating step preserves phase coherence at the lower frequencies to deter acoustic cancellation between the spatially proximate loudspeakers; and widening a stereophonic response of the sound reproduction system based on the frequency dependent decorrelating step.

12. The non-transitory computer readable storage medium as recited in claim 11, wherein the process further comprises:

pre-processing the stereo signal;

wherein the pre-processing step includes the decorrelating step.

13. The non-transitory computer readable storage medium as recited in claim 11 wherein the proximity corresponds to a separation of the at least two loudspeakers that, prior to the decorrelating step, at least partially reduces a fullness quality associated with the stereophonic response.

14. A system for modifying a stereo input that includes left and right input signals, to provide a widened impression when played back over a pair of loudspeakers that are less than 20 cm apart comprising:

means for modifying said left and right input signals, with a decorrelating process, to produce a decorrelated left channel signal and a decorrelated right channel signal wherein said decorrelated left channel signal is varied in phase relative to said left input signal according to the left channel phase response, and said decorrelated right channel signal is varied in phase relative to said right input signal according to the right channel phase response, and means for modifying said decorrelated left channel signal and said decorrelated right channel signal via a stereo-widening process, wherein outputs from said stereo widening process are fed to the said pair of loudspeakers, and wherein said left channel phase response matches closely to said right channel phase response at frequencies below a threshold frequency, and said left channel phase response differs from said right channel phase response at frequencies above said threshold frequency, where said threshold frequency is between 300 Hz and 3 kHz.

* * * * *